US008523390B2

(12) United States Patent
Dellian

(10) Patent No.: US 8,523,390 B2
(45) Date of Patent: Sep. 3, 2013

(54) FAIRY LIGHTS

(75) Inventor: Harald Dellian, Edling (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 672 days.

(21) Appl. No.: 12/531,880

(22) PCT Filed: Mar. 19, 2007

(86) PCT No.: PCT/EP2007/052585

§ 371 (c)(1),
(2), (4) Date: Sep. 18, 2009

(87) PCT Pub. No.: WO2008/113411

PCT Pub. Date: Sep. 25, 2008

(65) Prior Publication Data

US 2010/0128481 A1 May 27, 2010

(51) Int. Cl.
*F21V 33/00* (2006.01)

(52) U.S. Cl.
USPC ..... 362/249.01; 362/249.02; 362/249.14

(58) Field of Classification Search
USPC ..... 362/249.01, 249.02, 249.04, 249.06, 362/249.08, 249.14, 800
See application file for complete search history.

(56) References Cited

U.S. PATENT DOCUMENTS

| | | | | |
|---|---|---|---|---|
| 5,045,981 | A * | 9/1991 | Nagano | 362/219 |
| 5,330,368 | A | 7/1994 | Tsuruzono | |
| 6,866,394 | B1 * | 3/2005 | Hutchins et al. | 362/192 |
| 2006/0065818 | A1 * | 3/2006 | Shimokawa et al. | 250/221 |
| 2008/0239716 | A1 * | 10/2008 | Lin | 362/219 |

FOREIGN PATENT DOCUMENTS

| | | | |
|---|---|---|---|
| CN | 1075197 | A | 8/1993 |
| DE | 20309070 | U1 | 9/2003 |
| DE | 202005006643 | U1 | 9/2005 |
| WO | 0125681 | A1 | 4/2001 |

OTHER PUBLICATIONS

English language abstract for DE 202005006643 U1.
English language abstract for DE 20309070 U1.
International Search Report of PCT/EP/2007/052585 mailed Jun. 19, 2007.

* cited by examiner

*Primary Examiner* — Laura Tso

(57) ABSTRACT

A string of lights is provided. The string of lights may include a plurality of light sources, wherein the light sources are integrated into the string of lights and are embedded in a support part of the string of lights.

8 Claims, 4 Drawing Sheets

FAIRY LIGHTS

RELATED APPLICATIONS

The present application is a national stage entry according to 35 U.S.C. §371 of PCT application No.: PCT/EP2007/052585 filed on Mar. 19, 2007.

BACKGROUND

Various embodiments relate to a string of lights having a plurality of light sources.

Strings of lights, as can be attached to Christmas trees or other objects, such as walls of buildings, doors or door frames or the like, for purposes of illumination or decoration, are known. Since strings of lights of this type have relatively large light sources which are arranged such that they protrude substantially from the string of lights, there is a risk that the cable might get tangled or form cable balls when they are mounted or taken down. If the aim is to place the string of lights back into the packaging after use, this is virtually no longer possible since the provided placement positions can no longer be achieved due to the formation of cable balls. It is therefore relatively time-consuming to store it as intended, or the string of lights is simply placed into the pack in the form of the entire cable ball produced. Moreover, these known strings of lights can also experience kinks and cable breaks due to the cable being tangled, which will considerably impair the operational capability of the string of lights.

Not least, the entire string of lights is also relatively heavy and cumbersome due to the relatively large and protruding light sources. It is therefore also relatively complicated to mount them or take them down, and the light sources which protrude from the string of lights in the manner of candles often do not remain in their correct mounting positions due to their size and weight, but rather tilt or detach from the mounting position. In that case the string of lights then dangles loosely in space at this point.

SUMMARY

Various embodiments provide a string of lights being improved in a manner such that it is easier to manage.

A string of lights according to the invention includes a plurality of light sources which are preferably arranged such that they are spaced apart from one another in the string of lights. The light sources are integrated in the string of lights and are embedded in a support part of the string of lights. This embodiment enables the string of lights to have substantially the same thickness or the same diameter over its entire length. Even at those points where the light sources are arranged, the diameter or the embodiment of the string of lights is not thicker, or only marginally thicker, than at those points where no light sources are arranged. This embedded arrangement of the light sources can significantly improve the manageability. Cable entanglement during mounting or taking down can thus be prevented. Since the luminous means virtually no longer protrude from the string of lights, or only protrude slightly, placement in a pack after use can also be carried out in an uncomplicated and expedient manner. Kinks in the cable or cable breaks due to improper placement of the string of lights in the pack can thus be prevented. The string of lights according to the invention makes it simple to be placed in provided positions in the pack.

The string of lights is configured in particular in the manner of a strip and flexibly, and can thus be bent and deformed in various ways in order to be mounted on objects of various shapes and embodiments, for example on a tree or a door frame or the like.

To this end, the string of lights preferably has a plurality of attachment elements. By way of example, hooks or clips or interlocking tabs or the like can be provided for this, which are connected to the string of lights and arranged thereon.

The light sources are preferably surrounded by a tubular support part. In this embodiment, the light sources are thus arranged completely inside a tube. By configuring the support part in this way, it is not only possible to configure the string of lights to be very narrow over the entire length, but also to completely embed the light sources. Any damage, for example scratching or the like, can thereby be prevented. Since the tubular support part completely surrounds the light sources, protection against dirt can also particularly advantageously be ensured thereby.

The tubular support part preferably extends over the entire length of the string of lights.

In the embodiment with a tubular support part, the latter can be made of a flexible light-transmissive material. A very soft tube is particularly preferred and enables the string of lights to be mounted on a wide variety of objects with a wide variety of, and even relatively strong, torsions.

Provision can also be made for a light source to be embedded in the support part substantially flush with an outside of the support part. In such an embodiment, the outside of a light source is exposed. As a result of this, the light emission can be improved. By arranging the light source substantially flush and embedding it in the support part, it is possible to once more ensure protection against damage and also enable a compact embodiment which requires a minimum of installation space.

The string of lights preferably includes an upper part and a lower part which can be interconnected. The light sources are arranged in the upper part and cable ducts with at least one cable each are arranged in the lower part. The parts which are first provided separately can then be made with the components with they accommodate in each case, and they can afterwards be connected to one another in order to complete the string of lights. For the purposes of connecting them, clamping means or latching means or the like can be provided.

At least two, particularly three, parallel cable ducts are preferably formed in the lower part. Four cable ducts can also be provided, as a result of which it is possible to control red-green-blue color channels (RGB control). A wide variety of circuit concepts of the light sources in the string of lights can be made possible by way of contact-connecting one of more of these cables guided in the respective cable duct.

Placing the cables into cable ducts in the lower part can enable guided mounting of said cables, and a positionally accurate electrical contact-connection can be achieved. Moreover, this ensures a compact embodiment and protection of the cables.

Cutting elements are preferably integrated into the upper part, with each light source being electrically contact-connected to two cutting elements. The cutting elements are preferably arranged such that when the upper part and the lower part are joined, incisions are made into specific cables in the cable ducts and thus electric contact-connection is ensured. The cutting elements are intended to only produce an electric contact-connection to the cables, rather than to completely sever a cable. Due to these integrated cutting elements and their specific arrangement in the upper part, individual specific contact-connections of individual cables in the cable ducts become possible in turn, as a result of which specific circuit concepts of the string of lights can be realized.

It is preferably provided that cable separators are arranged in the upper part and one cable separator is preferably associated with each light source. A cable separator is an element which completely severs a cable arranged in a cable duct when the upper part is connected to the lower part. Here, too, it is the individual arrangement of a cable separator which can enable a precise and specific severance of a cable. When the upper part and the lower part are joined together, a desired cable is thus automatically severed using this integrated cable separator. The connection lines thus no longer have to be cut by hand.

Thus, when the upper part and the lower part are joined together, it is preferably possible, depending on the type and arrangement of the cutting elements, to make an incision into one or more cables in a cable duct or in cable ducts and thus to electrically contact-connect to a light source using a cable. Due to the incision, the electrically insulating sleeve of the cable is virtually opened up to an extent such that electrical contact-connection between the cutting element and the electrical conducting element inside, such as a copper wire or the like, is ensured.

A cutting element can for example be in the form of a so-called cutting tongue and have a V-shaped notch at the side facing a cable.

A cable separator preferably includes a cutting part which faces a cable. Moreover, a sleeve, in particular a plastic sleeve, is provided, which sleeve surrounds an element of the cable separator having the cutting part. By way of this external sleeve, reliable cutting open is ensured since the cut cable is virtually forced aside by this sleeve and the severed ends of the cable are pushed apart.

The light sources are preferably in the form of light-emitting diodes. This is particularly advantageous in an embodiment of the string of lights in which an upper part and a lower part which have to be joined together are present. Since this joining is accompanied by mechanical vibrations, and light-emitting diodes are insensitive with respect to such influences, damage to the light sources during joining can be avoided.

BRIEF DESCRIPTION OF THE DRAWINGS

In the drawings, like reference characters generally refer to the same parts throughout the different views. The drawings are not necessarily to scale, emphasis instead generally being placed upon illustrating the principles of various embodiments. In the following description, various embodiments are described with reference to the following drawings, in which.

DETAILED DESCRIPTION

The following detailed description refers to the accompanying drawings that show, by way of illustration, specific details and embodiments in which the invention may be practiced. These embodiments are described in sufficient detail to enable those skilled in the art to practice the invention. In this regard, directional terminology, such as "top", "bottom", "front", "back", "leading", "trailing", etc, is used with reference to the orientation of the Figure(s) being described. Because components of embodiments can be positioned in a number of different orientations, the directional terminology is used for purposes of illustration and is in no way limiting. Other embodiments may be utilized and structural, logical, and electrical changes may be made without departing from the scope of the invention. The various embodiments are not necessarily mutually exclusive, as some embodiments can be combined with one or more other embodiments to form new embodiments. The following detailed description therefore, is not to be taken in a limiting sense, and the scope of the present invention is defined by the appended claims.

Figure 1:
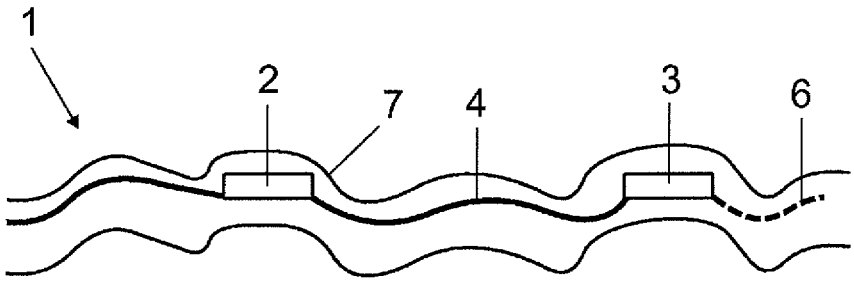
FIG. 1 shows a first exemplary embodiment of a string of lights according to the invention.

In FIG. 1, a schematic sectional illustration shows a first exemplary embodiment of a strip-like, flexible and thus variably deformable string of lights 1. The string of lights 1 is shown in a partial portion of its overall length. The string of lights 1 has a plurality of light sources 2, 3, which are in the form of light-emitting diodes in the exemplary embodiment and are arranged such that they are spaced apart in the string of lights 1. The light sources 2 and 3 are connected in series and interconnected via a signal line 4. Further signal lines 5 and 6 lead to further light sources (not shown).

The string of lights 1 furthermore includes a tubular support part 7 which completely surrounds the light sources 2 and 3 and the signal lines 4, 5 and 6. The tubular support part 7 is made of a highly flexible and light-transmissive material. The light sources 2 and 3 are thus completely integrated into the string of lights 1 and embedded in the support part 7. As can be seen, due to the way they are arranged and embedded, the light sources 2 and 3 are also arranged in the support part 7 and dimensioned such that the string of lights 1 has substantially the same thickness over its entire length. Even at the points where the light sources 2 and 3 are arranged, said thickness is the same, or slightly greater, than the thickness or diameter at those points of the string of lights 1 where no light sources 2 and 3 are arranged.

Figure 2:
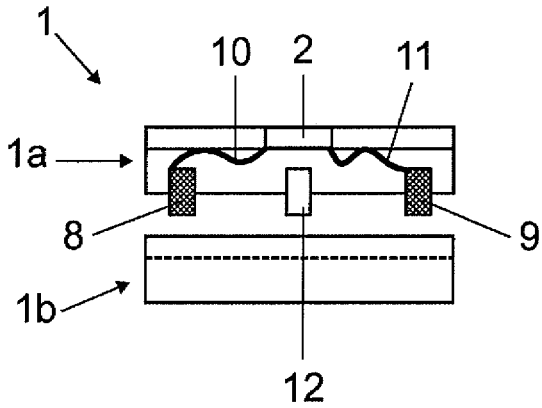
FIG. 2 shows a second exemplary embodiment of a string of lights according to the invention.

In FIG. 2, another exemplary embodiment of a string of lights 1 is shown in schematic sectional view. FIG. 2 also merely shows a partial portion of the entire length of the string of lights 1. In this embodiment, the string of lights 1 has an upper part 1*a* and a lower part 1*b* which are provided as separate parts. Both the upper part 1*a* and the lower part 1*b* are realized in the form of support parts. In the embodiment shown, a plurality of light sources (only light source 2 is shown) are embedded in the upper part 1*a* which is in the form of a support part. As is shown in FIG. 2, the light source 2 is embedded in the upper part 1*a* and integrated therein such that it is arranged virtually flush with the upper side or with that side of the upper part 1*a* which faces away from the lower part 1*b*. The light source 2 is therefore outwardly exposed in this embodiment. A relatively compact and flat embodiment of the string of lights 1 in terms of its thickness or its diameter can thus be made possible also by way of this embodiment.

The light source 2 is electrically contact-connected via signal lines 10 and 11 to two cutting elements 8 and 9 which are likewise integrated into the upper part 1*a*. Moreover, a cable separator 12 is integrated in the upper part 1*a*. The cutting elements 8 and 9, which are in the form of cutting tongues, and the cable separator 12 are integrated in the upper part 1*a* such that they protrude downwardly from the upper part 1*a*.

Figure 3:
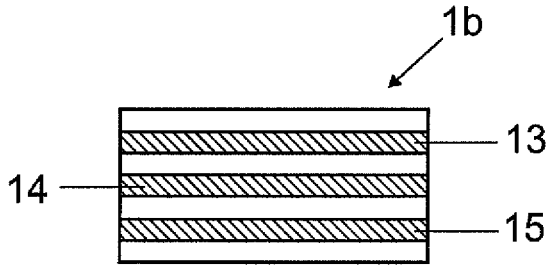
FIG. 3 shows a partial element of a string of lights from FIG. 2.

A plurality of parallel cable ducts 13, 14 and 15, which are arranged such that they are spaced apart, are formed in the lower part 1*b*, as can be seen in FIG. 3 in plan view. One cable is arranged in each of cable ducts 13, 14 and 15.

As will be explained below, the cutting elements 8 and 9 are used to make an incision in specific cables which are arranged in the ducts 13 to 15 when the upper part 1*a* and the lower part 1*b* are joined together. Moreover, the cable separator 12 is used to ensure complete severance in a cable 13 to 15.

Figure 4:
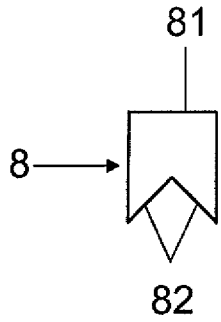
FIG. 4 shows another partial element of a string of lights from FIG. 2.

FIG. 4 shows a simplified side view of an exemplary embodiment of a cutting element 8. It has the shape of a dove tail and has an upper edge 81 at which the signal line 10 is contact-connected. On the opposite side, the cutting element 8 has a V-shaped notch 82 which is upside down and represents the cutting blade. It is arranged in a manner such that it protrudes from the upper part 1*a*.

Figure 5:
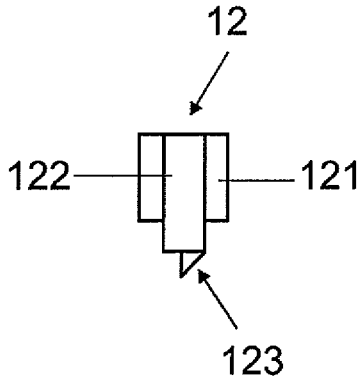
FIG. 5 shows a third partial element of a string of lights from FIG. 2.

FIG. 5 shows an exemplary embodiment of a cable separator 12. The cable separator 12 has a plastic sleeve 121 which surrounds an element 122, with a cutting tool 123 being arranged at the lower side of the element 122. The plastic sleeve 121 extends only partially over the entire length of the cable separator 12.

Figure 6:
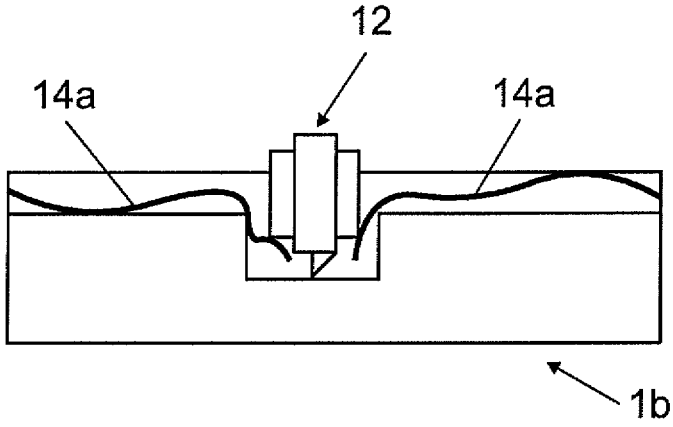
FIG. 6 shows an illustration of partial components of the string of lights from FIG. 2.

FIG. 6 shows a schematic sectional view, in which, in the assembled state of the upper part 1*a* and the lower part 1*b*, a cable 14*a* which extends in a cable duct 14 is completely severed. It can be seen that the plastic sleeve 121 ensures that the ends of the severed cable 14*a* are reliably moved apart.

Figure 7:
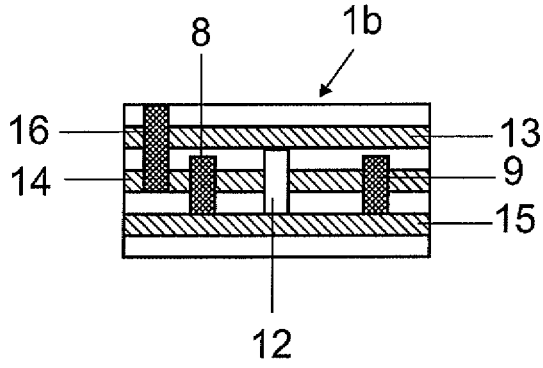
FIG. 7 shows a schematic plan view of a first embodiment of a contact-connection in a string of lights from FIG. 2.
Figure 8:
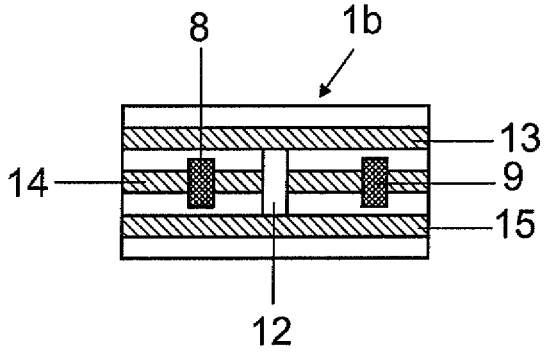
FIG. 8 shows a schematic plan view of a second embodiment of a contact-connection in a string of lights from FIG. 2.
Figure 9:
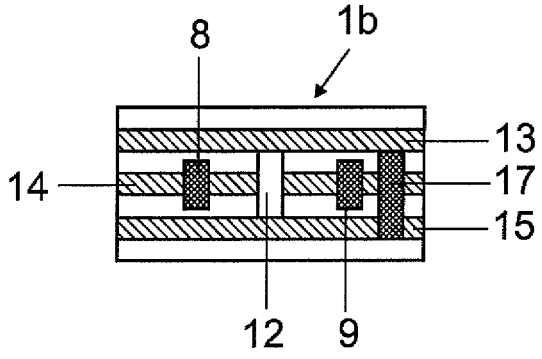
FIG. 9 shows a schematic plan view of another embodiment of a contact-connection in a string of lights from FIG. 2.
Figure 10:
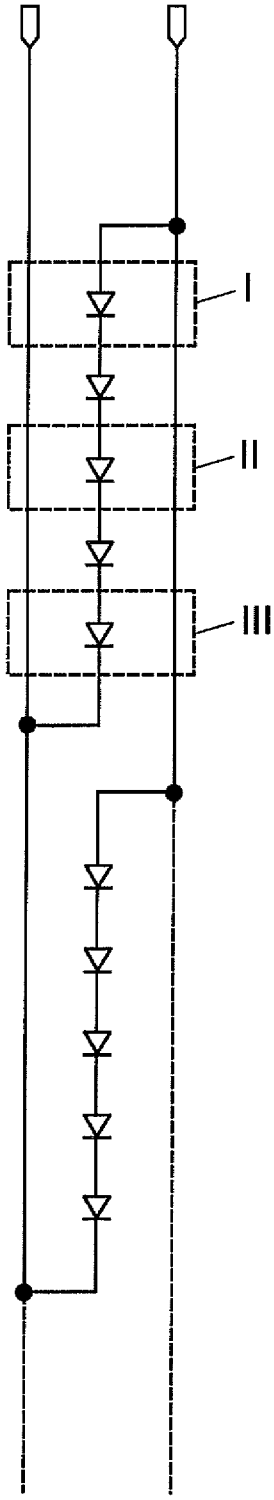
FIG. 10 shows a circuit arrangement of a string of lights, in which the embodiments from FIGS. 7 to 9 are realized.

In FIGS. 7 to 9, in a plan view, various embodiments of contact-connections in the string of lights 1 according to FIG. 2 are shown in each case in a schematic illustration. In this respect, FIG. 10 shows a simplified circuit design, in which in the upper portion, four light sources which are in the form of light-emitting diodes are connected in series between a voltage potential. FIG. 7 illustrates the first light-emitting diode or light source in FIG. 10 in the region I. The arrangement of the cutting elements 8, 9 and 16 and of the cable separator 12 is shown.

FIG. 8 shows a corresponding illustration in plan view, in which the arrangement is shown in this respect in region II of FIG. 10.

FIG. 9 shows another plan view of an embodiment of a circuit design, in which the region III in FIG. 10 is shown in this respect.

In the embodiments in FIGS. 7 and 9, the cutting elements 16 and 17 are arranged in each case above two cable ducts 13 and 14 or 14 and 15 and are designed for making an incision in the cables arranged in these cable ducts 13 and 14 or 14 and 15, and for electrically contact-connecting to them.

In FIGS. 7 to 9, the joined-together parts 1*a* and 1*b* of the string of lights 1 according to FIG. 2 are shown in a simplified schematic illustration. Proceeding from the illustration in FIG. 2, such a continuous connection between the upper part 1*a* and the lower part 1*b* can be enabled by clamping, clipping or latching. In particular, a mechanically stable connection between the upper part 1*a* and the lower part 1*b* can be enabled due to making the incision using the cutting elements 8 and 9 and the cable separator 12.

Curvatures in the cable ducts 13 to 15 can ensure strain relief for the cables. The curvatures are designed in the form of wave-type raised portions in the bottom of a cable duct and are arranged such that they are spaced apart in the longitudinal direction (horizontal direction in FIG. 3) of a cable duct 13 to 15. A cable in a cable duct 13 to 15 is thus guided or laid virtually over the bottom wave of the cable duct.

Four cable ducts in each of which one cable is arranged can also be formed in the lower part 1*b*. This enables control of light-emitting diodes with multi-color production. In particular for controlling the primary colors red, green and blue, in each case one control channel and one supply channel are in that case provided by in each case one line or one cable.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

The invention claimed is:

1. A string of lights, comprising:

a plurality of light sources, wherein the light sources are integrated into the string of lights and are embedded in a support part of the string of lights, wherein the string of lights comprises an upper part and an interconnectable lower part, the light sources being embedded in the upper part, which forms the support part, and cable ducts with cables arranged in the lower part, and wherein cable separators are arranged in the upper part and one cable separator is assigned to each light source.

2. The string of lights as claimed in claim 1, wherein a light source of the plurality of light sources is surrounded by a tubular support part.

3. The string of lights as claimed in claim 2, wherein the tubular support part extends over the entire length of the string of lights.

4. The string of lights as claimed in claim 1, wherein a light source of the plurality of light sources is embedded in the support part substantially flush with an outside of the support part.

5. The string of lights as claimed in claim 1, wherein three parallel cable ducts are arranged in the lower part.

6. The string of lights as claimed in claim 1, wherein cutting elements are integrated into the upper part and each light source is electrically contact-connected to cutting elements.

7. The string of lights as claimed in claim 1, wherein, upon joining the upper part and the lower part, an incision made into one or more cables electrically contact-connects said cables to said cutting element.

8. The string of lights as claimed in claim 1, wherein the light sources are light-emitting diodes.

* * * * *